United States Patent [19]

Dalman

[11] Patent Number: 5,020,580

[45] Date of Patent: Jun. 4, 1991

[54] HYDRAULIC DOOR CONSTRUCTION

[76] Inventor: Austin L. Dalman, Box 261, Balduc, Manitoba, Canada R0K 0B0

[21] Appl. No.: 367,632

[22] Filed: Jun. 19, 1989

[51] Int. Cl.[5] ..... E05D 15/00

[52] U.S. Cl. ..... 160/213; 160/188; 49/199

[58] Field of Search ..... 160/213, 188, 201, 206, 160/210; 49/199, 200, 360, 363

[56] References Cited

U.S. PATENT DOCUMENTS

| | | | |
|---|---|---|---|
| 2,393,052 | 1/1946 | Mehard | 160/213 X |
| 3,207,502 | 9/1965 | Houk | 160/188 X |
| 3,224,494 | 12/1965 | Houk | 160/213 |
| 3,238,995 | 3/1966 | Bonzer | 160/188 X |

FOREIGN PATENT DOCUMENTS

| | | | |
|---|---|---|---|
| 2229836 | 10/1973 | Fed. Rep. of Germany | 160/188 |
| 2371567 | 7/1978 | France | 160/213 |

*Primary Examiner*—Blair M. Johnson

*Attorney, Agent, or Firm*—Adrian D. Battison; Murray E. Thrift; Stanley G. Ade

[57] ABSTRACT

A hydraulically actuated door for a large opening of a building comprises a door formed in two parts divided by a horizontal hinge line so that a lower part can fold up under the upper part in an open position of the door. The upper part carries two flanges one at each side which project outwardly from the front face of the door. A ram extends from the base of a door post upwardly to the flange so that an upward force from the ram pivots the door about a horizontal hinge line at the top of the door to an open position in which the door extends outwardly from the horizontal hinge line. A level mechanism including a push rod pushes the lower portion of the door in a folding action around the center hinge line of the door up under the upper portion of the door into the folded position. Force from the opening action is thus communicated at the base of the posts rather than to the building and the door provides a wide opening with little height encumbrance and the actuating equipment on the exterior of the building.

13 Claims, 3 Drawing Sheets

HYDRAULIC DOOR CONSTRUCTION

BACKGROUND OF THE INVENTION

This invention relates to a door construction of a type for mounting on a building which can be opened by hydraulic action.

Doors are opened by hydraulic action are known and various designs have previously been proposed. One problem which arises however is that the force from the hydraulic ram is often communicated to the building structure thus requiring the building structure to be sufficiently strengthened at this point to accommodate the forces involved which can be relatively large when the door opening is large. Other problems which can arise are that the door can often restrict the height of the opening so that it is difficult to access the door opening with larger equipment and that the hydraulic mechanism is often positioned inside the building thus taking up valuable space.

It is one object of the present invention, therefore, to provide an improved design of hydraulically openable door which overcomes or at least reduces some or all of the above problems.

According to the first aspect of the invention there is provided a door arrangement for a building comprising a door, a door frame including a pair of vertical door posts, means mounting the door on the door frame for pivotal movement about a horizontal axis adjacent top of the posts from a closed position in which a plane of the door lies in the same plane as the posts to an open position in which the door extends outwardly from the horizontal axis, first and second coupling means each mounted on the door at a respective side thereof at a position projecting outwardly from the plane of the door, and first and second hydraulic ram means each extending from a base of a respective one of the posts to a respective one of the coupling means, the ram means being extendable from a first position in which the door is closed to a second position raising the door to the open position.

According to the second aspect of the invention there is provided a door arrangement for a building comprising a door, a door frame including a pair of vertical door posts, means mounting the door on the frame for pivotal movement about a horizontal axis adjacent top of the posts from a closed position in which the plane of the door lies in the same plane as the posts to an open position in which the door extends outwardly from the horizontal axis, the door being formed in two parts, a first one of the parts being mounted on the door frame at said horizontal axis for pivotal movement about said horizontal axis and a second of the parts being mounted on the first part and foldable relative thereto about a second axis parallel to said horizontal axis the second part in the open position of the door being arranged such that it is folded under the first part so as to lie directly parallel thereto, and a first and a second lever mechanism extending between said first part of the door and the second part of the door and arranged to cause movement of the second part of the door into the folded position in dependence upon pivotal movement of said first part about said horizontal axis.

The design of door described herein can provide the following advantages:

1. The door can used on implement sheds, workshops, barns, cattle sheds or almost any building requiring a large door.

2. It can be made to very large sizes depending upon the material used for its construction. It can be insulated to the same R-factor as the walls of the building on which it is installed.

3. The door can provide an almost unobstructed ceiling height with no mechanism inside the building.

4. Most of the forces of raising and lowering and folding the door are transferred to the ground level at the base of the posts thus requiring very little extra strength to be built into the building to accommodate the door.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

The door construction according to the present invention comprises a rectangular door generally indicated at 10 which is mounted upon a door frame 11 formed by a pair of door posts 12 and 13. Each of the posts defines a horizontal pivot axis at an upper end thereof and the door includes a hinge mechanism 14 by which the door can pivot about the horizontal axis at the top of the posts from a closed position in which the door lies in the same vertical plane as the post to an open position in which the door is raised and stands outwardly from the horizontal axis.

Each of the posts comprise a simple vertical post structure which supports the weight of the door with the post being supported in its vertical position either by connection to the building or using a cross-member (not shown). The majority of the force provided by the door is carried on the post with little force being transmitted to the building.

The door is formed in two substantially equal parts divided at a horizontal line 15 which is formed by a second hinge mechanism parallel to the main horizontal hinge of the door.

Figure 1:
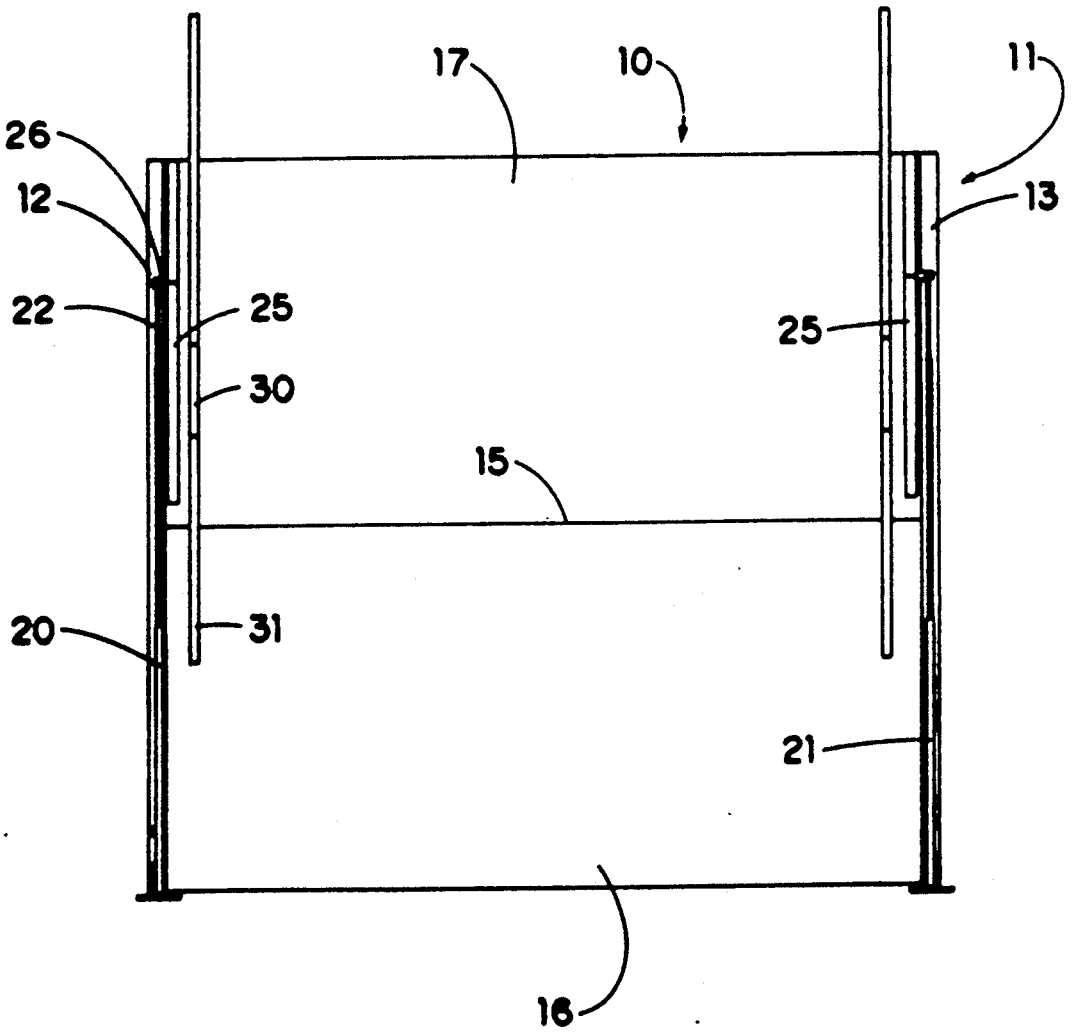
FIG. 1 is a front elevational view of a door according to the present, invention with the door in the closed position.
Figure 2:
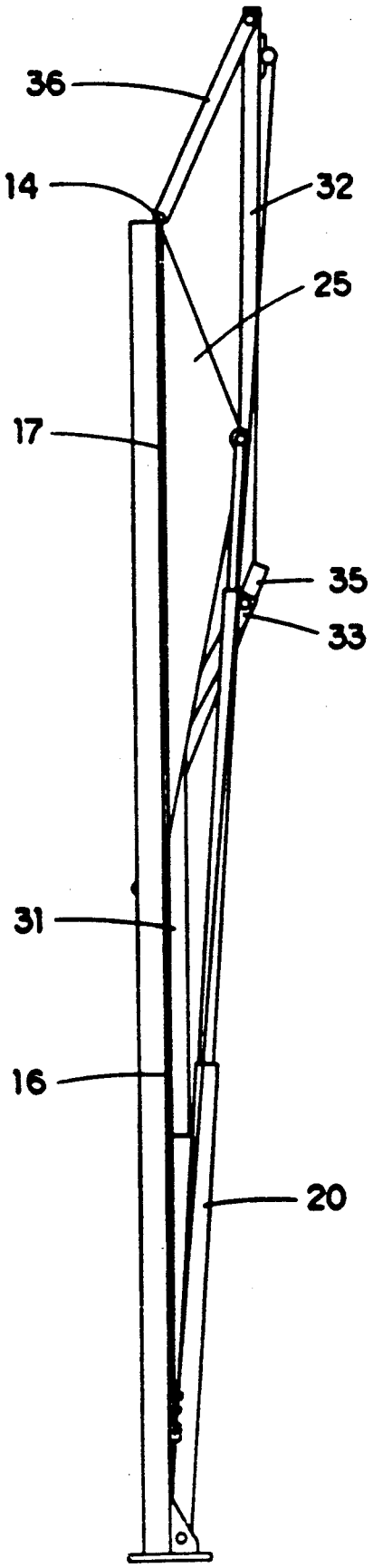
FIG. 2 is a side elevational view of the door FIG. 1 also in a closed position.
Figure 3:
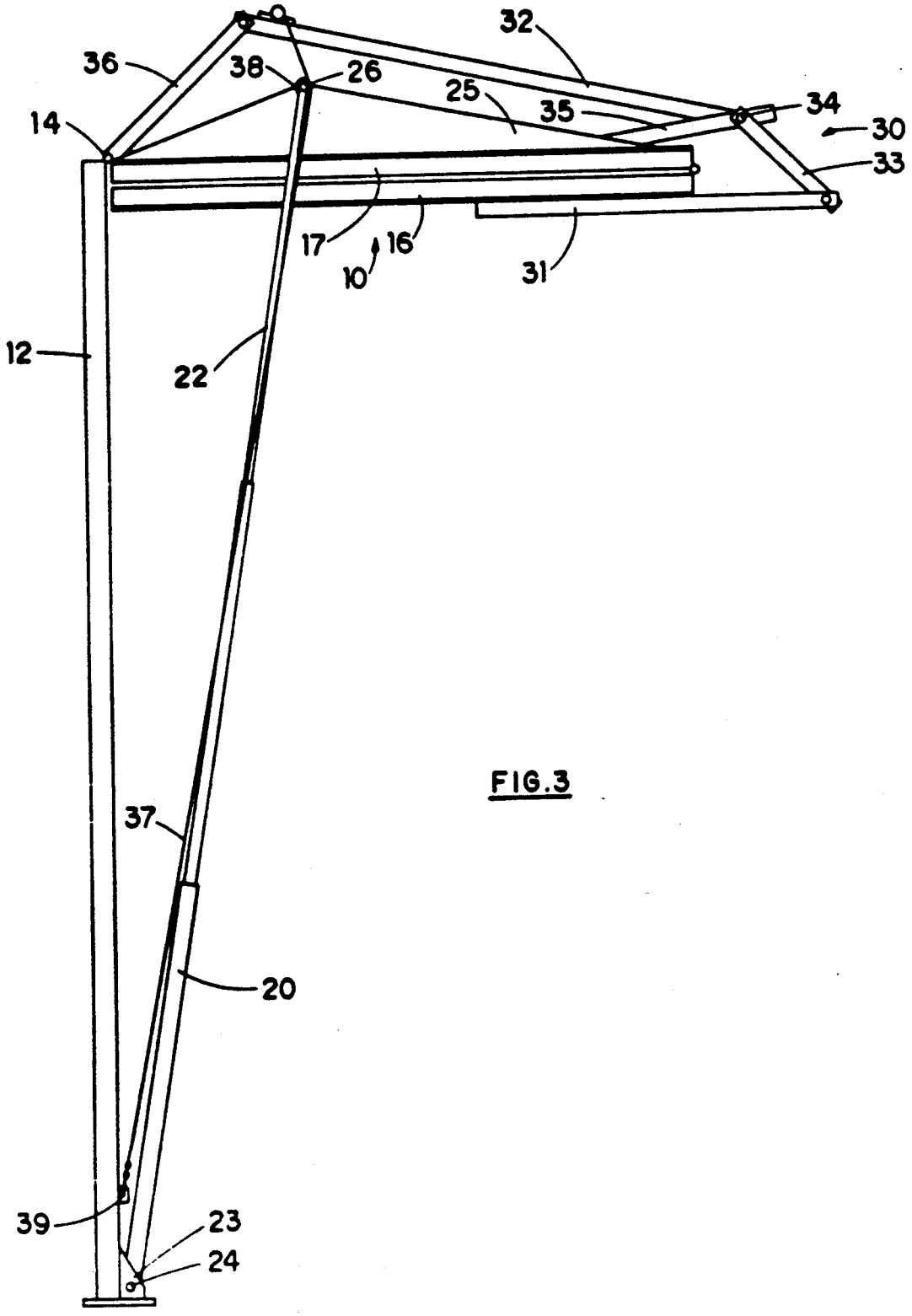
FIG. 3 is a side elevational view similar to FIG. 2 showing the door in the open position thereof.

In FIGS. 1 and 2 the door is in the closed position with both of the parts of the door lying in the vertical plane defined by the posts. In FIG. 3 the door is in an open condition with the lower part 16 of the door lying parallel to and directly underneath the upper part 17 of the door in a folded condition with both of the parts extending substantially directly outwardly from the first horizontal axis of the door so the parts lie in a substantially horizontal plane defined by the top of the door opening.

In order to provide the opening action of the door there is provided a pair of rams 20 and 21 which are hydraulically actuated so as to provide an outward movement of a piston rod 22. The lower end of the ram 20 is mounted upon a bracket 23 forming a part of the post 12, 13. More specifically the bracket 23 comprises a pair of flanges which project outwardly from respective sides of the square cross-section post with the ram being confined between the flanges and mounted for pivotal movement about a pin 24.

On an outer face of the upper part of the door at each side of the door is mounted a flange 25 which is shaped in the form of a triangle with a long side of the triangle mounted on the outer face of the door and the other side of the triangle converging to an apex spaced outwardly from the front surface of the door by a distance of the order of six to eight inches. At the apex is mounted a bearing element 26 which is supported within the body of the flange. The flange is braced by suitable front and rear surfaces bent at right angles to the main body of the flange so that the bearing element 26 is rigidly maintained at a position on the door spaced outwardly from the front face of the door by the distance of the order of six to eight inches. The bearing element 26 is connected to the outer end of the rug 22 so the force from the ram is communicated to the bearing element and thus to the flange.

As shown in FIG. 2 the ram in the closed position thus is inclined slightly forwardly from base of the post to the bearing element 26 with the rod 22 retracted. A downward force on the rod 22 acts to pull the door into the closed position so that it is maintained in that position against flapping in the wind. An extension motion of the rod 22 is applied to the bearing element 26 and thus to the flange and as the bearing element is forward of the vertical plane including the hinge 14, the door is pushed into an open position and thus pivots about the hinge 14. This action thus moves the first or upper part of the door into the open position shown in FIG. 3.

In order to move the lower part of the door into the folded position, there is provided a lever mechanism generally indicated at 30. The lever mechanism is provided for each side of the door adjacent the flange and just inside the flange. The lever mechanism is shown only schematically in FIG. 1 but is shown in more detail in FIGS. 2 and 3.

The lever mechanism comprises a lever member 31 fixed on the outer face of the lower part 16 of the door and extending along the front face and outwardly beyond the hinge 15. In the closed position shown in FIG. 2, the lever 31 extends along the front face of the upper portion 17. In the open position shown in FIG. 3 the lever extends outwardly beyond the hinge 15 and the folding action on the door portion 16 about the hinge line 15 is provided by force on the outer end of the lever 31. This force is provided by a pushing mechanism including a push rod formed by first push rod portion 32 and a second push rod portion 33. The portions are pivotally connected at a pin 34 with the pin being supported away from the outer face of the first portion 17 of the door by a lever coupling 35. The lever is pivotally mounted on the flange at its inner end and at the pin 34 at its outer end so as to hold the push rod away from the door. The upper end of the push rod portion 32 is connected to a similar lever coupling 36 which is pivotally connected to its lower end to the hinge 14 and at its upper end to the push rod portion 32. A cable 37 is connected to the push rod portion 32 adjacent the lever coupling 36 so that in the open position shown in FIG. 3 it applies a forward force on the push rod which tends to turn both the lever coupling members 35 and 36 in a clockwise direction and to force the lever 31 into the folded position of the lower part of the door. The cable 37 passes around a pulley 38 mounted on the bearing member 26 and has a lower end 39 connected to a suitable fixed position on the device which is preferably adjacent the lower end of the post.

In a closed position of the door, the door is held in place by the downward force of the ram on the flange 25. As the door moves to the open position under the force of the ram, the upper portion pivots upwardly around the hinge line 14 which causes the lower portion to pivot also in a clockwise direction around the hinge 15 to take it the folded position shown in FIG. 3.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A door arrangement for a building comprising a door, a door frame including a pair of vertical door posts, means mounting the door on the door frame for pivotal movement about a horizontal axis adjacent the top of the posts from a closed position in which a plane of the door lies in the same plane as the posts to an open position in which the door extends outwardly from the horizontal axis, the door being formed in the first and a second part, the first part being mounted on the door frame at said horizontal axis for pivotal movement about said horizontal axis and the second being mounted on the first part and foldable relative thereto about a second axis parallel to said horizontal axis, the second part in the open position of the door being arranged such that it is folded under the first part so as to lie directly parallel thereto, and including a first and a second lever mechanism extending between said first part of the door and the second part of the door and arranged to cause movement of the second part of the door into the folded position in dependence upon pivotal movement of said first part about said horizontal axis, first and second coupling means each fixedly mounted on the first part of the door at a respective side thereof at a position projection outwardly from the plane of the door, and first and second extendable hydraulic cam means, means connecting one end of each ram means to a base of a responsive one of the posts to communicate force from the door solely to the base, means connecting an opposed end of each ram means to a respective one of the coupling means, the ram means being extendable from a first position in which the door is closed to a second position raising the door to the open position.

2. The invention according to claim 1 wherein each of the coupling means comprises a flange mounted on the door and lying in a plane at right angles to the door such that the flange extends outwardly from the door, and a bearing element mounted on the flange at a position spaced from the plane of the door and connected to one end of the ram means.

3. The invention according to claim 2 wherein the flange is triangular with a base o the triangle lying along an outer face of the door and the bearing element mounted at an apex of the triangle remote from the door.

4. The invention according to claim 1 wherein each lever mechanism includes an elongate straight lever connected to the second part and lying substantially in the plane of the second part so as to extend therefrom beyond the second axis, and pushing means mounted on the first part of the door arranged to push the second part into the folded position thereof.

5. The invention according to claim 4, wherein the pushing means comprises a pushing rod, a first coupling lever mounted on the first part of the door at and in thereof adjacent the horizontal axis and the second coupling lever mounted on the first part at a position thereon spaced outwardly of the horizontal axis, the pushing rod being coupled to both of said coupling levers for movement longitudinal of the first part in a pushing action.

6. The invention according to claim 5 wherein the pushing rod comprises a first portion between the two coupling levers and a second portion pivotal relative to the first portion and extending from said second coupling lever to said first lever on said second part of the door.

7. The invention according to claim 6 including means for providing a force longitudinal of the pushing rod.

8. The invention according to claim 7 wherein the means for providing the force comprises a cable which is connected to the pushing rod at a position thereon adjacent the horizontal axis, the cable passing over a pulley mounted on the first part of the door and extending from the pulley to a fixed position relative to the frame.

9. A door arrangement for a building comprising a door, a door frame including a pair of vertical door posts, means mounting the door on the frame for pivotal movement about a horizontal axis adjacent top of the posts from a closed position in which the plane of the door lies in the same plane as the posts to an open position in which the door extends outwardly from the horizontal axis, the door being formed in a first and second part, the first part being mounted on the door frame at said horizontal axis for pivotal movement about said horizontal axis and the second part being mounted on the first part and foldable relative thereto about a second axis parallel to said horizontal axis, the second part in the open position of the door being arranged such that it is folded under the first part so as to lie directly parallel thereto, and a first and a second lever mechanism extending between said first part of the door and the second part of the door and arranged to cause movement of the second part of the door into the folded position in dependance upon pivotal movement of said first part about said horizontal axis, wherein each lever mechanism includes an elongate straight lever connected to the second part and lying substantially in the plane of the second part so as to extend therefrom beyond the second axis, and pushing means mounted on the first part of the door arranged to push the second part into the folded position thereof.

10. The invention according to claim 9 wherein the pushing means comprises a pushing rod, a first coupling lever mounted on the first part of the door at and in thereof adjacent the horizontal axis and the second coupling lever mounted on the first part at a position thereon spaced outwardly of the horizontal axis, the pushing rod being coupled to both of said coupling levers for movement longitudinal of the first part in pushing action.

11. The invention according to claim 10 wherein the pushing rod comprises a first portion between the two coupling levers and a second portion pivotal relative to the first portion and extending from said second coupling lever to said first lever on said second part of the door.

12. The invention according to claim 11 including means for providing a force longitudinal of the pushing rod.

13. The invention according to claim 12 wherein the means for providing the force comprises a cable which is connected to the pushing rod at a position thereon adjacent the horizontal axis, the cable passing over a pulley mounted on the first part of the door and extending from the pulley to a fixed position relative to the frame.

* * * * *